US006351214B2

(12) United States Patent
Eskildsen et al.

(10) Patent No.: US 6,351,214 B2
(45) Date of Patent: Feb. 26, 2002

(54) GLASS BREAKAGE DETECTOR

(75) Inventors: Kenneth G. Eskildsen, Bayside, NY (US); Ying Xiong, Middleton, WI (US); Christopher R. Paul, Bayport; John E. Foster, Huntington, both of NY (US)

(73) Assignee: Pittway Corp., Chicago, IL (US)

( * ) Notice: Subject to any disclaimer, the term of this patent is extended or adjusted under 35 U.S.C. 154(b) by 0 days.

(21) Appl. No.: 09/829,118

(22) Filed: Apr. 9, 2001

Related U.S. Application Data

(63) Continuation of application No. 09/238,016, filed on Jan. 26, 1999, now Pat. No. 6,236,313, which is a continuation-in-part of application No. 08/959,352, filed on Oct. 28, 1997, now abandoned.

(51) Int. Cl.[7] ..... G08B 13/00

(52) U.S. Cl. ..... 340/550; 340/566; 340/541; 340/426; 181/56; 181/104

(58) Field of Search ..... 340/550, 566, 340/541, 426; 381/56, 104

(56) References Cited

U.S. PATENT DOCUMENTS 4,134,109 A * 1/1979 McCormick et al. ..... 340/550
4,333,170 A * 6/1982 Mathews et al. ..... 367/125
5,107,249 A * 4/1992 Johnson ..... 340/541
5,172,093 A * 12/1992 Nose et al. ..... 340/426
5,229,748 A * 7/1993 Ehringer et al. ..... 340/566
5,323,141 A * 6/1994 Petek ..... 340/566
5,438,317 A * 8/1995 McMaster ..... 340/550
5,608,377 A * 3/1997 Zhevlev et al. ..... 340/506
5,796,366 A * 8/1998 Ishino et al. ..... 340/566
5,917,410 A * 6/1999 Cecic et al. ..... 340/541

* cited by examiner

*Primary Examiner*—Daniel J. Wu
*Assistant Examiner*—Tai T. Nguyen
(74) *Attorney, Agent, or Firm*—Greenberg Traurig, LLP; Anthony R. Barkume

(57) ABSTRACT

A method and a device for detecting the breakage of glass. A glass breakage detector that uses an acoustic transducer, an analog-to-digital converter, and a processing means which uses software algorithms to determine if a signal received by the acoustic transducer is a result of glass breaking. The glass breakage detector also uses amplifiers which have a greater gain response for higher frequency components in the received signal. The glass breakage detector is also able to correct the offset error generated by the amplifiers. The processing means or digital signal processor (DSP) uses a feature extraction software algorithm that extracts characteristics of the received sound using a plurality of filters centered at different frequencies and a rules analysis software algorithm to compare the extracted features to features from glass breakage and false alarms. The DSP is also capable of transmitting the extracted features to an external computing device for further analysis. The DSP may use different software routines which may be selected by a user to process the signal from the acoustic transducer. The software algorithms used by the DSP may be modified or customized for optimally detecting a glass breakage event.

35 Claims, 19 Drawing Sheets

Bandpass Filter Parameters

| Filter | Frequency | Q |
|---|---|---|
| A | 116 Hz | 0.75 |
| B | 1700 Hz | 5.00 |
| C | 5800 Hz | 2.50 |
| D | 9000 Hz | 4.00 |
| E | 13000 Hz | 4.00 |
| F | 5000 Hz | 5.00 |

FIG. 5C

GLASS BREAKAGE DETECTOR

CROSS-REFERENCE TO RELATED APPLICATION

This patent application is a continuation application of U.S. application Ser. No. 09/238,016, which was filed Jan. 26, 1999, now U.S. Pat. No. 6,236,313, which is incorporated by reference, which is a continuation-in-part application of U.S. application Ser. No. 08/959,352, which was filed on Oct. 28, 1997, now abandoned, which is also incorporated by reference herein.

BACKGROUND OF THE INVENTION

This invention relates to glass breakage detectors, and in particular to glass breakage detectors that utilize digital signal processing to determine if the signals produced by an acoustic transducer are the result of glass breakage. The term glass breakage as used herein refers to the breakage of framed glass, such as windows or doors, and not to the breakage of glass items, such as drinking glasses and the like.

Home and commercial security systems commonly use glass breakage detectors to detect the presence of an intruder. When an intruder breaks a window to enter the premises, the glass breakage detector detects the breakage of glass and an alarm is sounded. Glass breakage detectors with acoustic transducers monitor the sounds in the local environment. Acoustic glass breakage detectors of the prior art monitor the amplitude of the sound at frequencies that are typically associated with glass breakage to determine if the received sound is a result of glass breakage.

Acoustic detectors available today have a tendency to generate false alarms on other noises found in the home or business such as the shaking of keys, slamming of a file drawer, clapping of hands, etc. In order to reduce the incidence of false alarms, acoustic detectors of the prior art use multiple analog filters in order to selectively pass only frequencies associated with the breakage of glass. A glass breakage detector which comprises multiple hardware filters and which monitors the amplitude of the filtered signals is disclosed in U.S. Pat No. 5,323,141, which is incorporated by reference herein. The amplitudes within the chosen bands are compared to a predetermined threshold value in order to detect the glass breakage.

Another glass breakage detector of the prior art, disclosed in U.S. Pat No. 5,552,770, recognizes temporal events that typically accompany glass breakage. The high frequency sound of the impact is detected, followed by low frequencies caused by flexing of the glass due to the impact, and high frequencies again when the glass breaks by shattering. An alarm signal is issued by the glass breakage detector only when the detected low frequencies last for a predetermined minimum duration beginning not before the first detection of high frequencies. This glass breakage detector uses hardware filters and timing circuits to detect the glass breakage. Such a detector is an improvement over other acoustic detectors, but the improvement comes at the cost of extra hardware circuits. The size and cost of the hardware places limits on the number of filters a detector can have.

Acoustic detectors of today need adjustments during installation to work properly in the different environments in which they are installed. Acoustic waves resulting from a glass breakage event are a function of glass type, window frame configuration, room acoustics, and distance from the window. A small change in distance between the window and the transducer results in a large change in the received sound level. A range adjustment allows an installer to change the sensitivity of the acoustic detector to adapt it to its placement in the room. This adjustment may sometimes cause the detector to miss a glass breakage event. When the range setting is adjusted improperly by the installer, the breaking of a window may not exceed the detector's threshold. To compound the problem, the installer remains unaware of the improper installation since a typical installation generally does not involve breaking an actual window. Some manufacturers design acoustic detectors with high gain amplifiers to ensure detection of glass breakage from the maximum recommended distance; this, however, results in amplifier saturation when the detector is mounted near the glass. It would be advantageous to have an acoustic detector which operates reliably over a vast range of sound levels thereby reducing installation errors.

In many environments, sounds specific to that environment create false alarms that are not easily discriminated against by acoustic detectors available today. In these environments, it would be advantageous to customize the detector by analyzing the sounds produced by the specific false alarm and modifying the detector to discriminate against that sound. It would also be advantageous to store the features of the sounds that generate an alarm so that later analysis of these features is possible.

It is therefore an object of the present invention to provide a glass breakage detection device with increased sensitivity without increased false alarms.

It is a further object of the present invention to provide a glass breakage detection device that detects a plurality of the features generated during a glass breakage event.

It is a further object of the present invention to provide a glass breakage detection device that may be adapted to detect a simulated glass breakage event during installation.

It is a further object of the present invention to provide a glass breakage detection device with the ability to be modified to include updated technology or to be customized for a particular environment.

It is a further object of the present invention to provide a glass breakage detection device that compensates for the characteristics of the room in which it is mounted.

It is a further object of the present invention to provide a device that corrects the front end offset errors of the glass breakage detection device.

It is a further object of the present invention to provide a device that transmits and stores features for computer analysis.

SUMMARY OF THE INVENTION

In accordance with these and other objects, the present invention is a method and a device for detecting the breakage of framed glass. The glass breakage detector comprises an acoustic transducer for sensing acoustic waves, an analog-to-digital (A/D) converter, and a processing means which uses software algorithms to extract features indicative of characteristics of the acoustic wave sensed by the acoustic transducer and analyze the extracted features to determine if the acoustic wave was a result of glass breaking. The acoustic transducer is adapted for a substantially flat gain response of the frequency range from approximately 20 Hz to approximately 20 kHz and the A/D converter samples the signal produced by the acoustic transducer at 44.1 kHz.

The glass breakage detector further comprises amplifiers for amplifying the analog signal from the acoustic transducer. The gain response of the amplifiers is greater for higher frequency components and approximately unity for lower frequency components. The offset error generated by the amplifiers may be corrected by the processing means before the signal is used for determining glass breakage. The processing means collects samples of the DC component of the amplified signal and samples of the amplified signal. To calculate the offset error, the processing means collects 1024 samples of both signals, subtracts the samples, and computes an average of the differences. The processor will subtract the computed average from future samples of the amplified signal to correct the offset error.

The processing means or digital signal processor (DSP) uses a feature extraction software algorithm that extracts features using a plurality of filters centered at different frequencies. The features include the summed energy, the period, the symmetry, and the number of zero crossings of the signal after it is filtered. Once the features are extracted, they are compared with stored values to determine if the sound is the result of a glass breakage by the rules analysis software algorithm. The processing means also uses an algorithm which distinguishes against difficult false alarms by checking the extracted features against characteristics of specific false alarms such as keys on a window. The processing means is also capable of transmitting the extracted features to an external computing device for further analysis.

An important feature of the present invention is the ability of the processing means to use different software routines which may be selected by a user for processing the signal from the acoustic transducer. A user can operate a switch to select a software algorithm from a number of sets of rules to analyze the extracted features to determine if the received waves are a result of glass breakage. This may be useful for reducing false alarms created by different environments. Similarly, a test mode switch causes the processing means to use a different software algorithm (that uses a 5 kHz filter) to extract features and a different rules analysis software algorithm to compare the extracted features against predetermined thresholds.

Another feature of the present invention is the ability of the factory to make changes to the software algorithm. Changes are made simply by reprogramming the algorithm stored in the processor's memory. This feature allows the glass breakage detector to be easily updated with current technology without changing any of the hardware, thereby keeping it from becoming obsolete. This feature also allows the glass breakage detector to be customized to meet specific requirements of different environments.

Modifying or customizing the processing performed by the acoustic detector is accomplished by the following steps: generating a sound, sensing the sound with an acoustic transducer, processing the sound by digital conversion, extracting the features, transmitting the extracted features to an external computing device, analyzing the extracted features with the external computing device, determining a modification to the algorithm stored in memory, and modifying the algorithm.

Another aspect of the present invention is a processing device that can receive a signal from an acoustic transducer and process the signal using an algorithm stored in memory to determine if the signal is the result of glass breakage. The processing device may be located in a common housing with the acoustic transducer or may be located remotely from the transducer, receiving the signal by hardwired connection, optical transmission or radio frequency (RF) transmission. The device may also receive signals from a number of acoustic transducers, each having a unique identification number (ID). The signals from each acoustic transducer may be processed using the same algorithm or separate algorithms that correspond with the ID's of the acoustic transducer.

The processing device may also have means for communicating to a control unit, a console, or a central station in order to receive commands. The commands include selecting different software algorithms from a set of predefined algorithms stored in memory to process the signal from the acoustic transducer. The commands may also modify a software algorithm stored in memory, or cause the processing device to transmit the extracted features stored in memory. The extracted features which may be from a historical event or a real time event may be transmitted to a central station via the communication means. This would allow the central station to monitor what has happened or what is presently happening in the environment that the acoustic detector is monitoring.

BRIEF DESCRIPTION OF THE DRAWINGS

FIG. 5C is a table of parameters for the six digital filters of the present invention.

DETAILED DESCRIPTION OF THE PREFERRED EMBODIMENT

Figure 1:
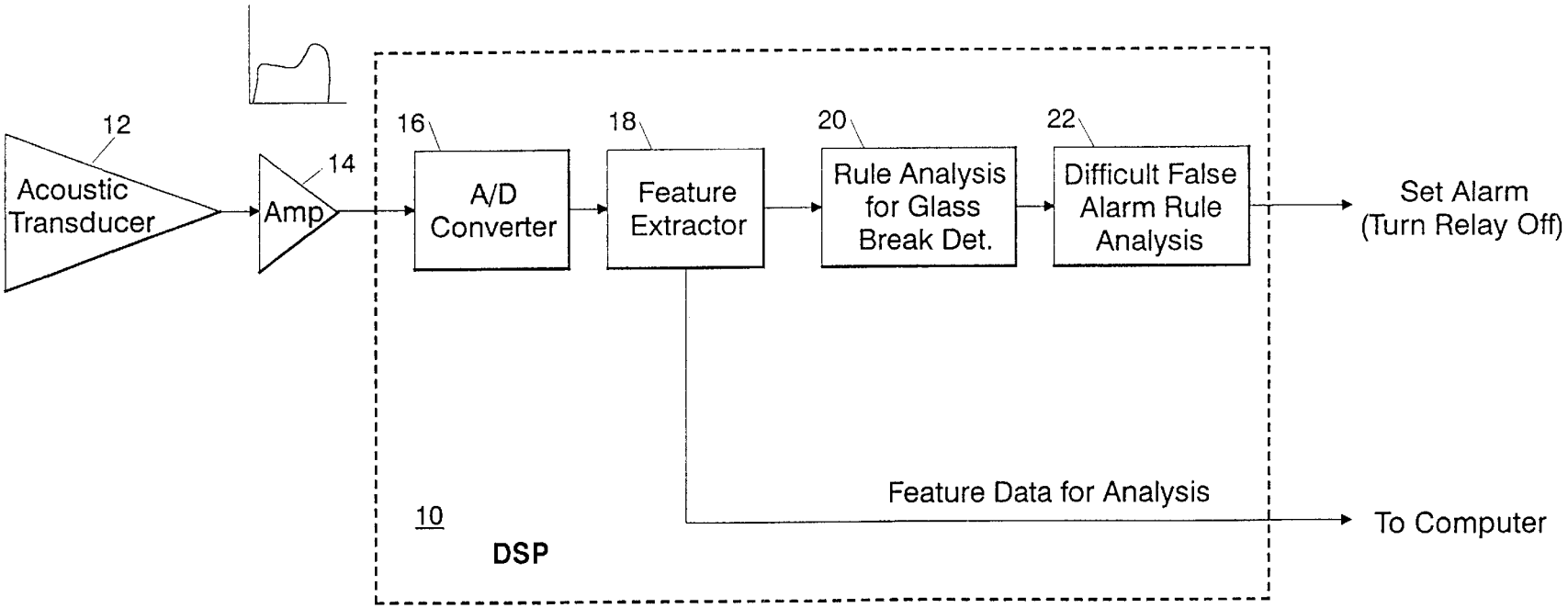
FIG. 1 is a block diagram of the operation of the preferred embodiment of the present invention.

Referring to FIG. 1, a glass breakage detector is shown, which includes an acoustic transducer 12, and amplifier 14, and a digital signal processor (DSP) 10. The acoustic transducer 12 senses acoustic waves over a wideband frequency range and translates them into an electrical signal that is then applied to a low gain amplifier 14. The DSP 10 inputs the resultant signal and processes the signal as follows. The A/D converter 16 samples the signal from the amplifier 14 and translates it into digital words which are used by the feature extractor algorithm 18 to determine the features of the signal at the acoustic transducer 12. The features include the energy in each of five filters, the zero crossing periods, the symmetry of the signal, etc., as fully described below. These features may be transmitted to a computer for further analysis. Once the features are extracted, they are compared with stored values to determine if the sound is a false alarm or a glass breakage by the rule analysis algorithm 20. Lastly, the difficult false alarm algorithm 22 checks the features against thresholds that are characteristic of specific false alarms such as a slammed microwave door, a balloon pop, a key on a window, etc. If the sound is determined not to be a false alarm, a signal is transmitted to a central control unit (not shown) that sets the alarm, as well known in the prior art.

One distinction between the present invention and the prior art is that the output of the acoustic transducer 12 (and the amplifier 14, which may be eliminated) is digitally processed by the DSP 10. There are no analog bandpass filters or threshold detectors necessary to condition the signal prior to the processor. The A/D converter 16 (which if desired may be external to the DSP 10) converts the wideband signal from the transducer to a digital word, and all of the filtering and processing needed for glass breakage detection is done by an algorithm programmed in the memory of the DSP 10. In the preferred embodiment of the present invention, the DSP 10 is a Z89273 which is a general purpose digital signal processor manufactured by Zilog. Although DSP's are well known to one skilled in the art, the use of a DSP with an acoustic transducer for determining glass breakage is novel.

Figure 2:
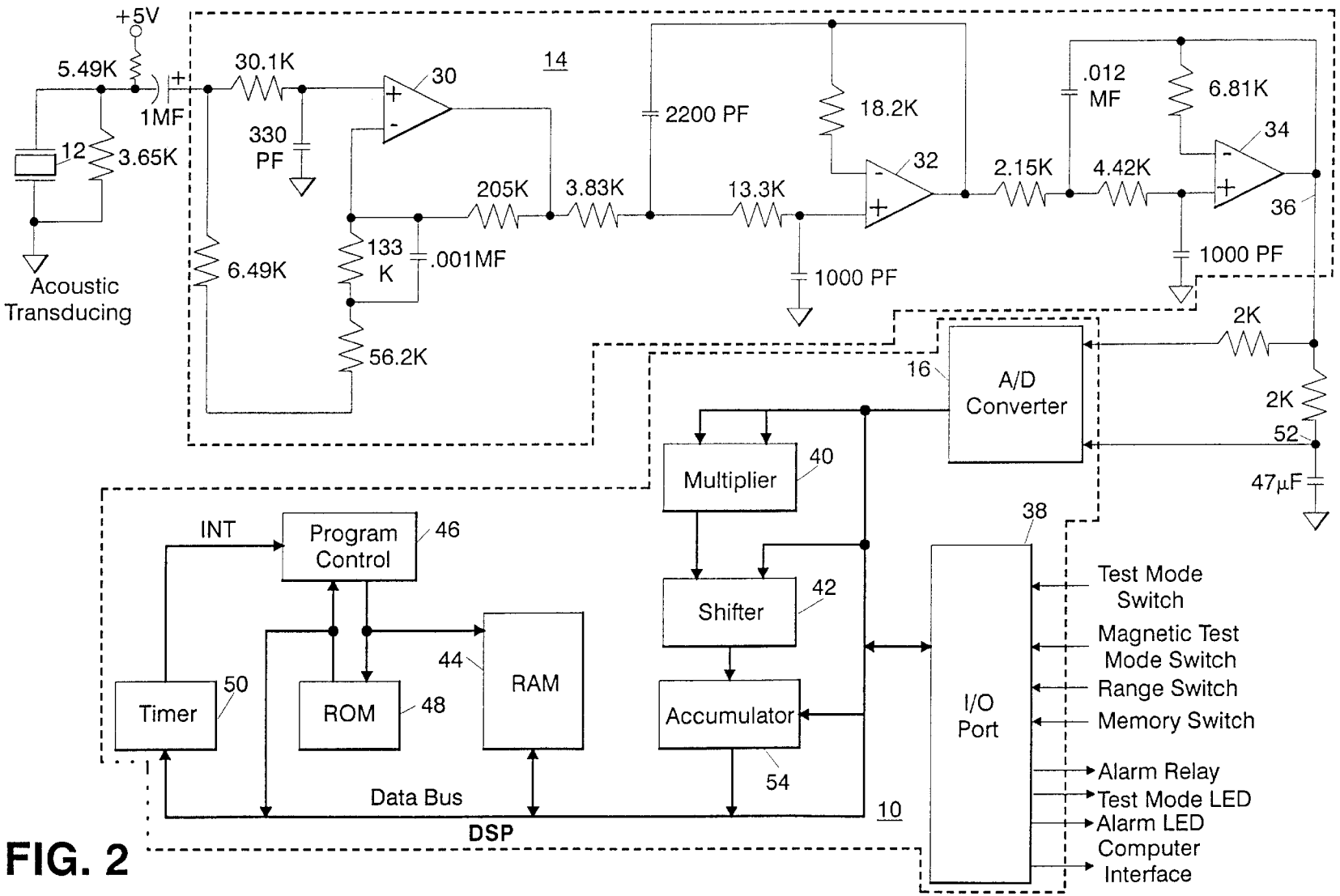
FIG. 2 is a functional block diagram of the preferred embodiment of the present invention.
Figure 3:
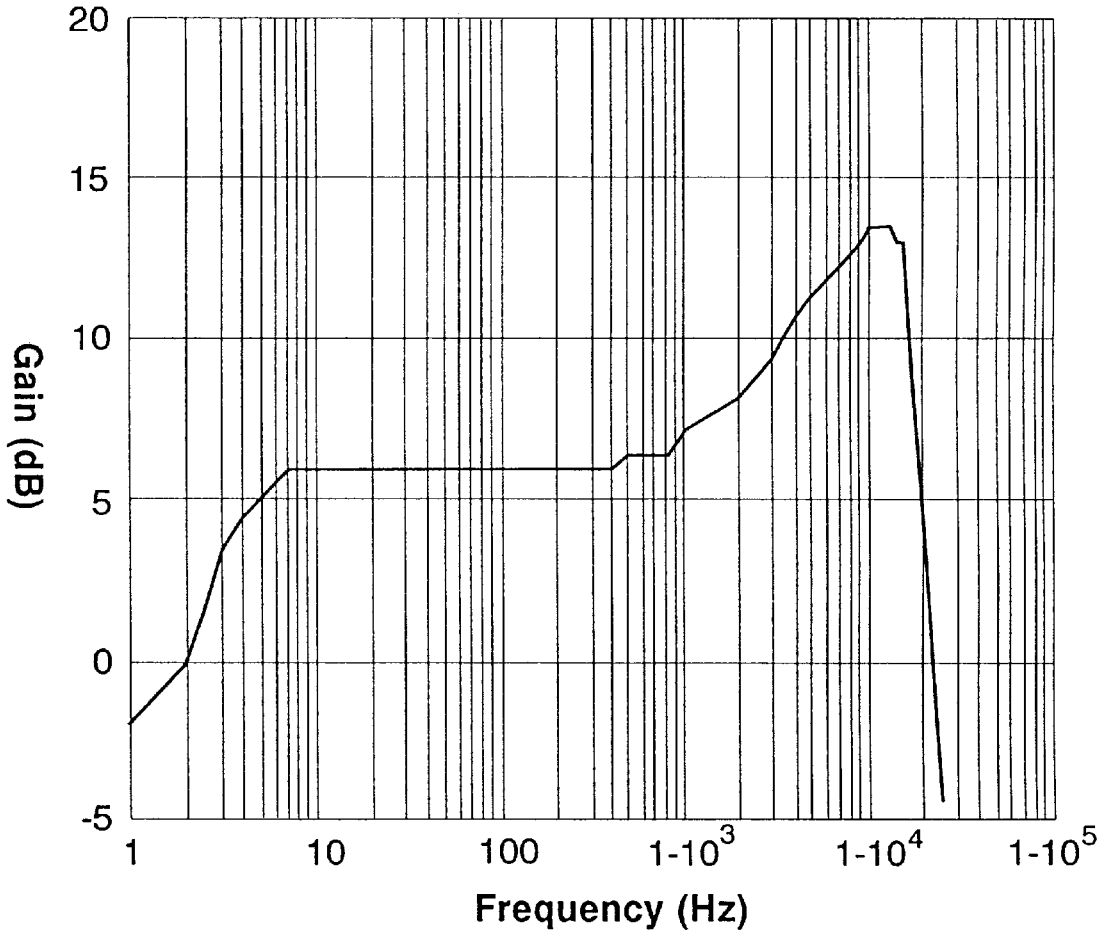
FIG. 3 is a graph of the gain response versus frequency for the amplification circuit of the preferred embodiment of the present invention.

Shown in FIG. 2 is the functional block diagram of the preferred embodiment of the present invention. The acoustic transducer 12, which has a flat gain response over the frequency range of approximately 20 Hz to 20 kHz, produces an electrical signal biased at approximately 2v. The electrical signal is amplified by low gain amplifier 14, which is comprised of three amplifier stages 30, 32, and 34 and which produces the frequency gain response shown in FIG. 3. This gain response shows an increase in the gain of the higher frequencies, 1 kHz to 13 kHz, to compensate for the attenuation of the high frequency sound waves by objects in the environment (such as curtains and carpets). The first amplifier stage 30 performs the wave shaping that increases the gain of the high frequency signals, and the second and third amplifier stages 32 and 34 perform a steep roll off of approximately 72 dB between 13 kHz and 22.5 kHz for anti-aliasing. The circuit components and design of these amplifier stages are well known to one skilled in the art and will not be discussed further.

The resultant signal 36 is connected to DSP 10 through a 2k ohm resistor. Signal 36 is also filtered to produce signal 52 which is also connected to the DSP 10. Signal 52 is used to determine any offset error that may have built up over time due to component value changes. The DSP 10 is programmed to sample the analog data from signals 36 and 52 and convert them to digital data every 22.6 microseconds. If a digital sample from signal 36 is greater than a predetermined threshold, the data from signal 36 are processed by the feature extraction algorithm 18 stored in ROM 48. If the digital data are not above a predetermined threshold, the data from signals 36 and 52 are used to determine the offset error, further described below.

Using the feature extraction algorithm 18 stored in ROM 48, the program control 46 transfers the digital data from signal 36 to the multiplier 40, which multiplies the digital data by filter coefficients, shifts the results in shifter 42, and accumulates the shifted results in accumulator 54 before storing the results in RAM 44. After collecting 35 milliseconds of data, the program control 46 stops collecting data by turning off the data collection interrupt from timer 50. The stored feature extraction results, now in RAM 44, are then processed by the rule analysis algorithm 20 and the difficult false alarm algorithm 22 (both also stored in ROM 48) to determine if the received signal is the result of glass breakage, as will be described below.

When the signal is determined to be the result of glass breakage, program control 46 causes the alarm output signal to change state (to active) by writing to input/output (I/O) port 38. In the preferred embodiment, all outputs from and inputs to DSP 10 are sent through I/O port 38. These include the computer interface; the alarm LED, which is lit after an alarm has been signaled; the memory switch, which causes the alarm LED to continue to stay lit after an alarm has occurred (rather than stay lit for only 3 seconds); the test mode switch, which causes program control 46 to run a test mode algorithm stored in ROM 48; the magnetic test mode switch, which is the same as the test mode switch except the switch is controlled by a magnet (this is so the cover of the unit does not need to be removed); the test mode LED, which is lit during test mode; and the range switch, which causes program control 46 to use a different rule analysis algorithm also stored in ROM 48.

A significant aspect of the present invention is the ability of the user to change the DSP processing of the input analog signal simply by changing a switch selection such as the test mode switch or the range switch. The test mode switch causes the program control 46 to use a 5 kHz filter for feature extraction and to compare the extracted features with different rules. A different algorithm is preferred when checking the reliability of the detector because the glass break sound is simulated rather than actual. The range switch allows the installer to select different rules for greater false alarm immunity.

Another significant aspect of the present invention is the ability to make changes to the DSP's processing of the input analog signal simply by, in the preferred embodiment, replacing the DSP 10 with an identical DSP which has the new algorithms stored in ROM 48 or, in an alternative embodiment, reprogramming the algorithms stored in an erasable non-volatile memory (as well known in the art). In the preferred embodiment, the replacement of the DSP 10 is performed by a technician in the factory. In the alternative embodiment the user or installer may be able to perform the reprogramming of the algorithms by using a communications device that has the capability of transmitting commands capable of reprogramming the algorithms, as is done with devices such as EPROM programmers. This feature allows the glass breakage detector to be easily updated with current technology without changing any of the hardware, thereby keeping it from becoming obsolete. This feature also allows the glass breakage detector to be modified or customized to meet specific requirements of different environments.

Another significant aspect of the present invention is the ability to correct the offset error that has built up over time due to component value changes. The DSP 10 converts signal 36 and signal 52 to digital numbers, and when an acoustic wave is not detected, the DSP 10 subtracts the two digital numbers and accumulates the result. After subtracting and accumulating 1024 times, the DSP 10 divides the result in the accumulator by 1024 to determine the offset error. The offset error is subtracted from the digital data representative of the analog signal 36. The offset error is continuously calculated until an acoustic wave has been detected on signal 36. The glass breakage detector is able to perform this feature without additional hardware simply because of the versatility of the DSP 10.

Figure 4A:
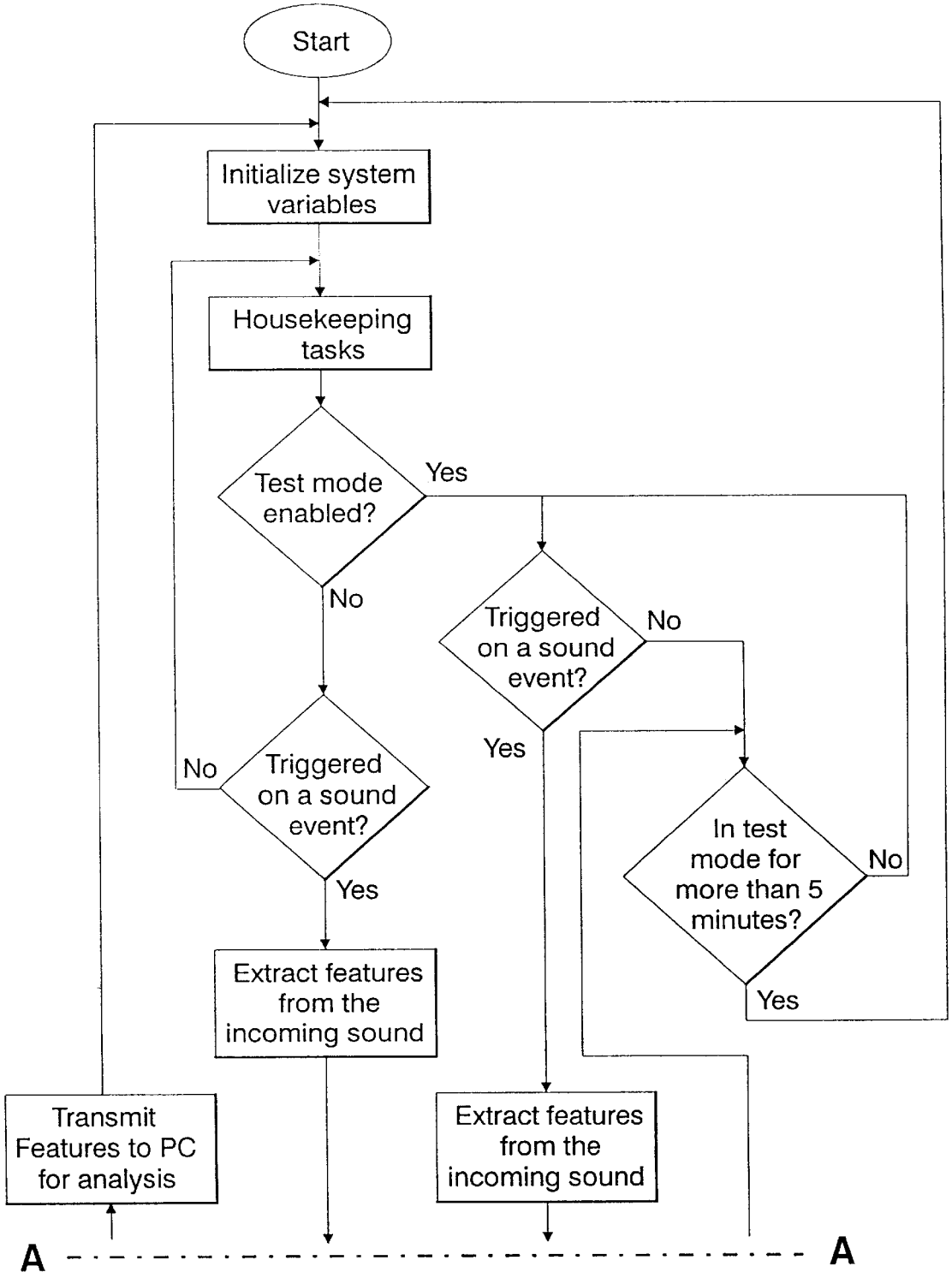
FIGS. 4A and 4B combine together to form the top level flow chart of the operation of the present invention.
Figure 4B:
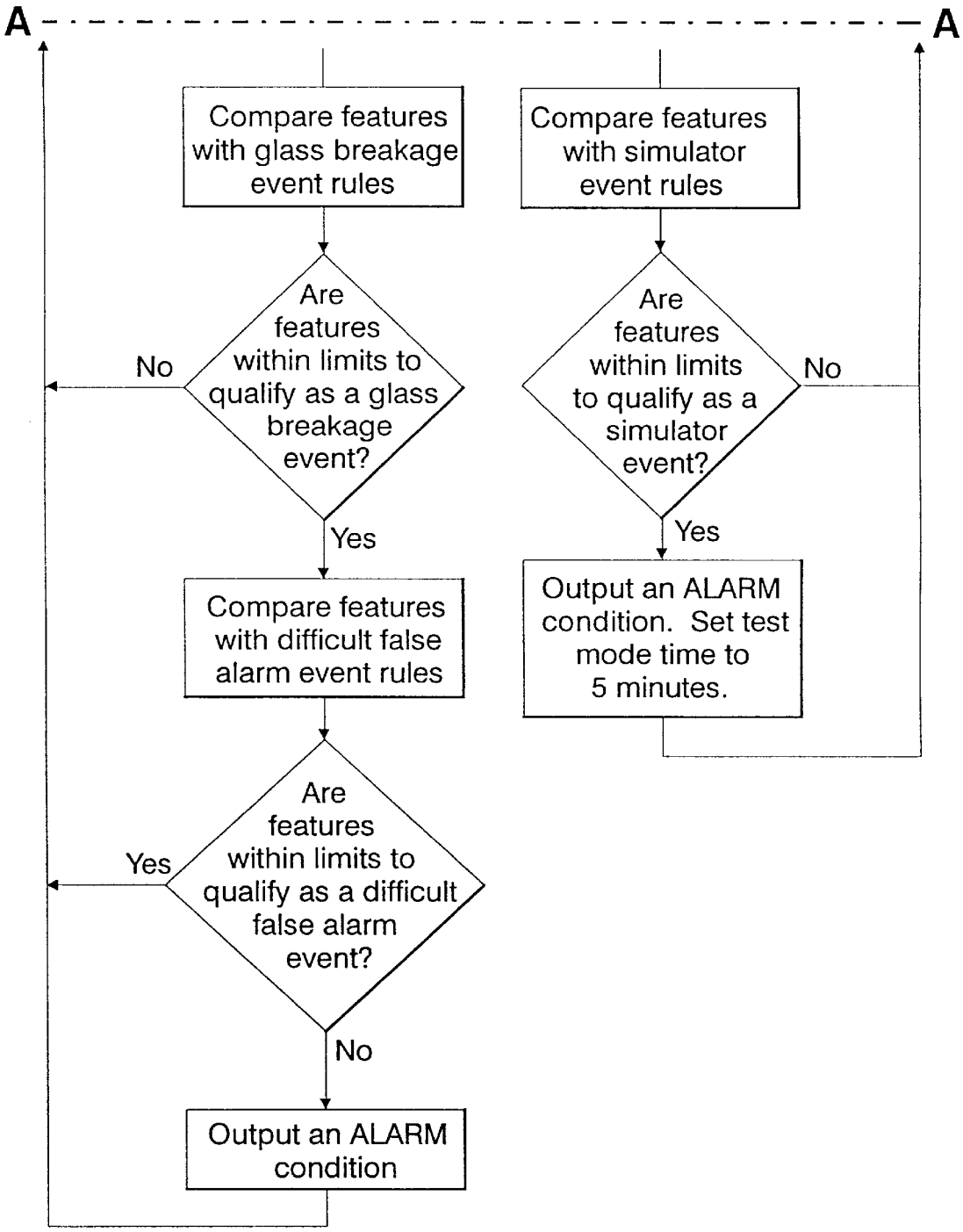

The basis of the present invention is the use of software algorithms programmed in DSP 10 to determine if an acoustic transducer received acoustic waves that were the result of glass breakage. A top level flow chart of the software algorithm is shown in FIGS. 4A and 4B. The DSP 10 first initializes the system variables which include the timer interrupt or A/D sample rate (44.1 kHz). The DSP 10 then performs housekeeping tasks which include maintaining the watch dog timer (1 second timer that resets the DSP 10 if it locks up), checking the inputs from I/O port 38, and computing the offset error. If the test mode has been selected, the DSP 10 waits for a sound event to be detected, that is, the digital word from the A/D converter 16 to be above a predetermined threshold for two consecutive sample periods. While the DSP 10 is waiting to detect a sound event, it checks to make sure the DSP 10 has not been in test mode for greater than five minutes. This feature keeps the glass breakage detector from being left in test mode inadvertently. Once a sound event is detected, the DSP 10 extracts the features from the incoming sound and compares the features with the simulator event rules. If the features are within limits to qualify as a simulator event, an alarm condition is output and the test mode timer is extended for an additional five minutes. If the features are not within limits to qualify as a simulator event the timer is checked for greater than five minutes and the DSP 10 waits for another sound event to occur.

If the test mode has not been selected, the DSP 10 waits for a sound event to be detected, in the same manner as described in the test mode. It continues to do housekeeping tasks until a sound event has been detected. Once a sound event has been detected, the DSP 10 extracts features from the incoming sound (these are different features from the test mode features), compares the features with glass breakage event rules, and compares the features with difficult false alarm event rules. If either of these comparisons is not within predetermined limits, then the features are transmitted to the computer for analysis and the routine goes back to the start of the algorithm. If both comparisons are within limits, first an alarm condition is sent out and then the features are transmitted to a computer (if connected) for analysis and the routine goes back to the start of the algorithm.

When detecting a glass breakage event, it is well known in the art to monitor signal amplitudes at specific frequencies that are typically associated with glass breakage. In the present invention, this process is performed by the feature extraction algorithm 18. The uniqueness of the present invention is that because this process is performed by a DSP 10 using a software algorithm, many more frequencies can be monitored and many other features, besides amplitude, can be analyzed.

Figure 5A:
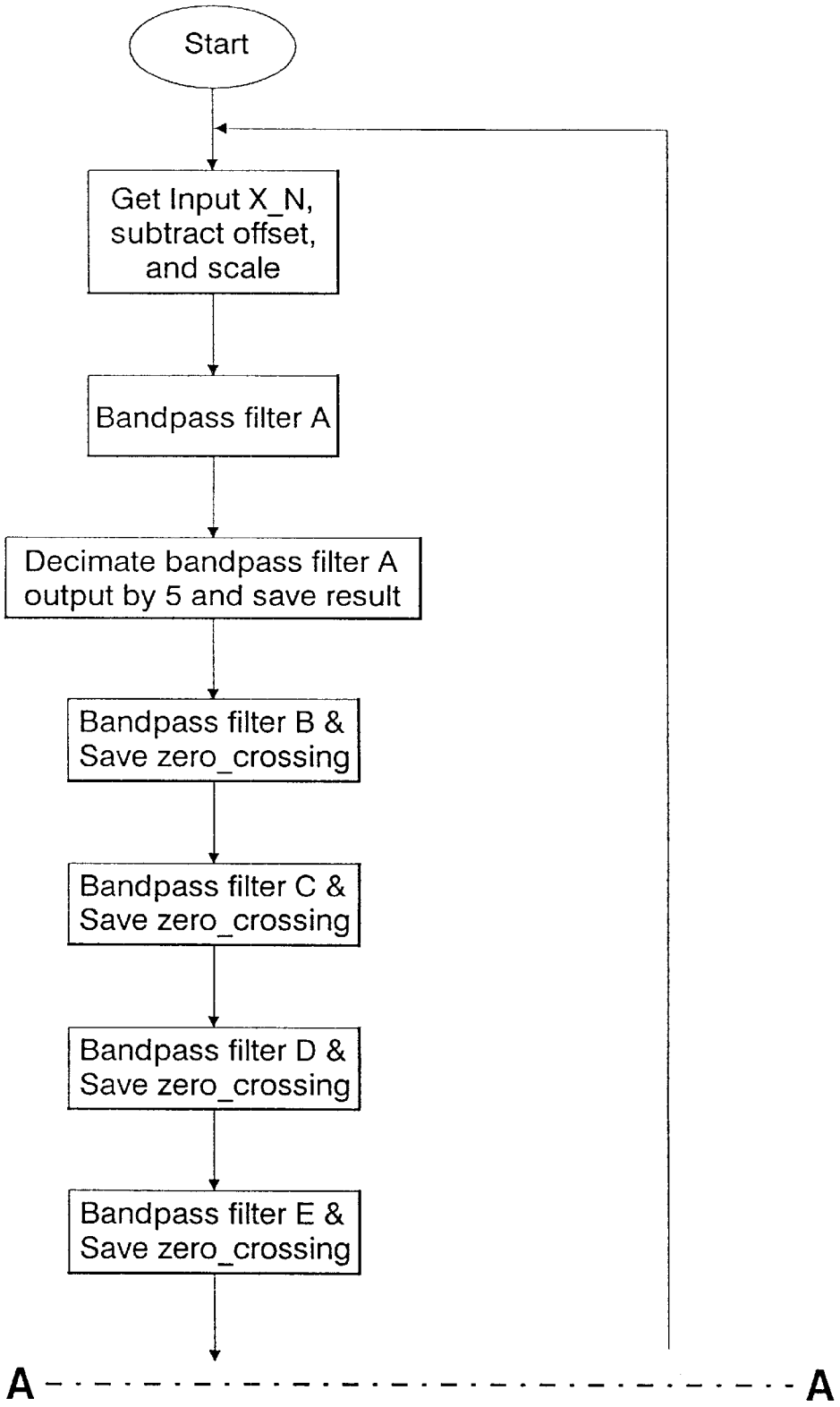
FIGS. 5A and 5B combine together to form the flow chart of the operation of the glass breakage event feature extractor algorithm.
Figure 5B:
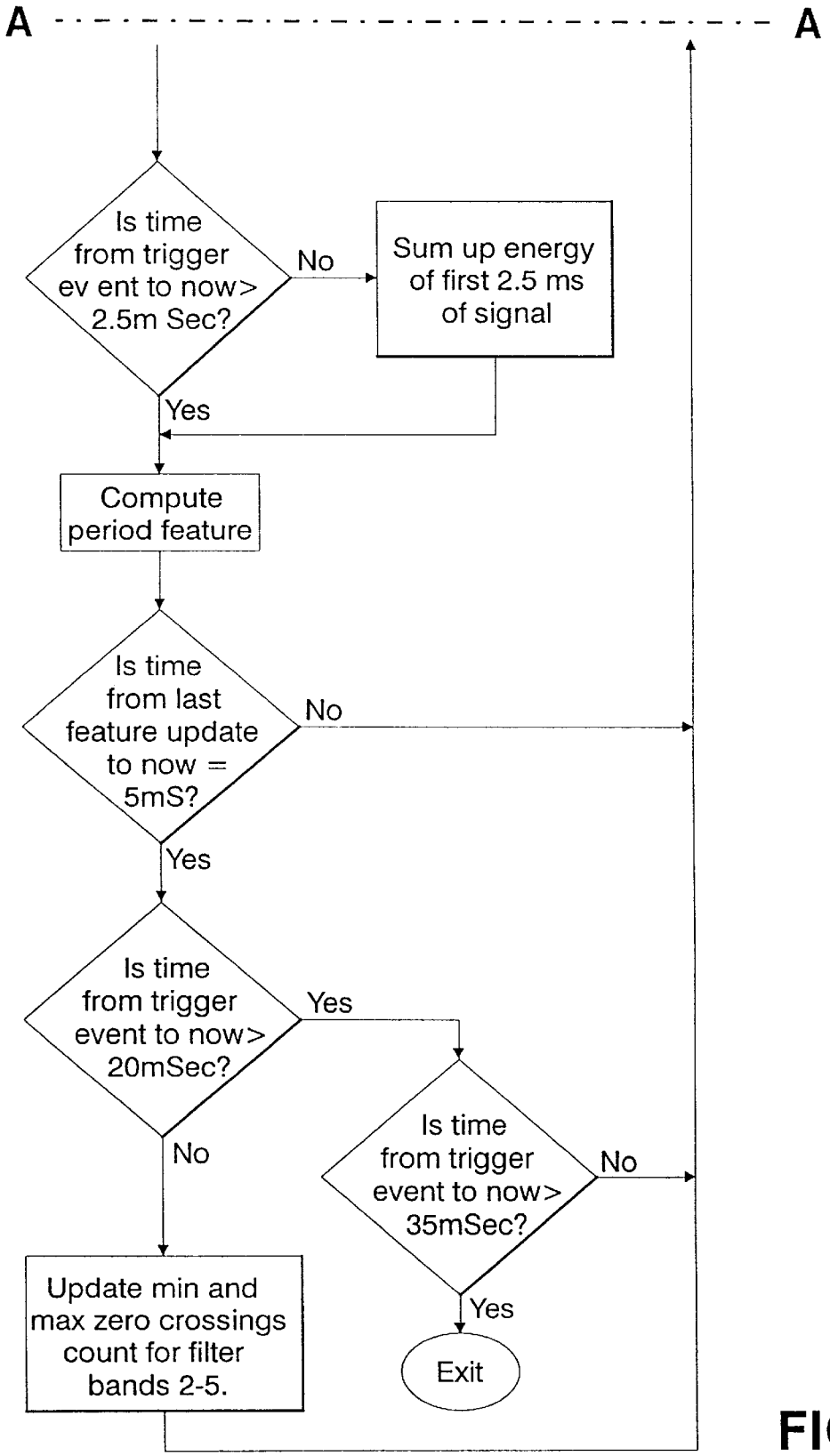
Figure 6A:
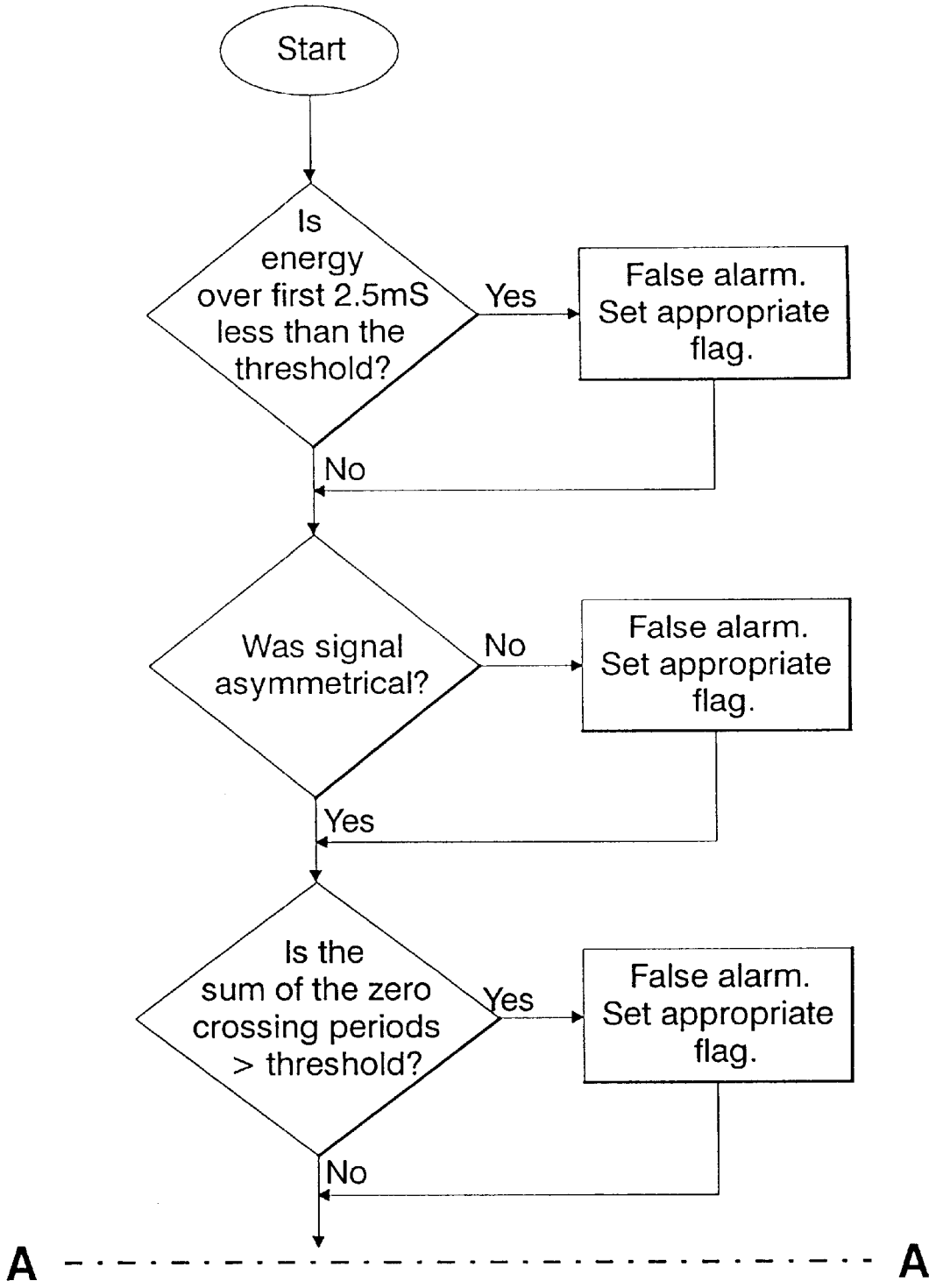
FIGS. 6A, 6B, 6C, 6D, 6E, and 6F combine together to form the flow chart of the operation of the glass breakage event rules.
Figure 6B:
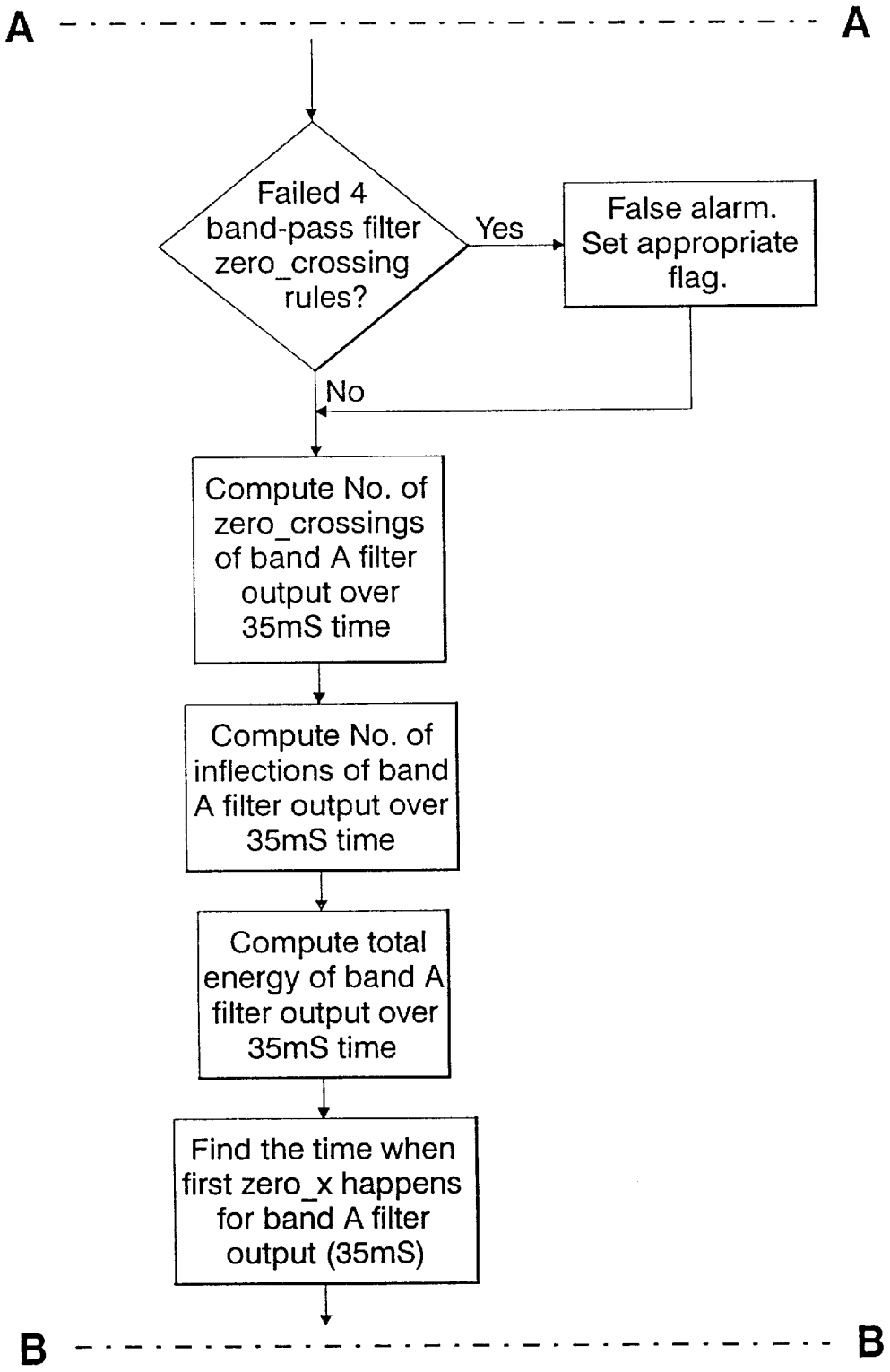
Figure 6C:
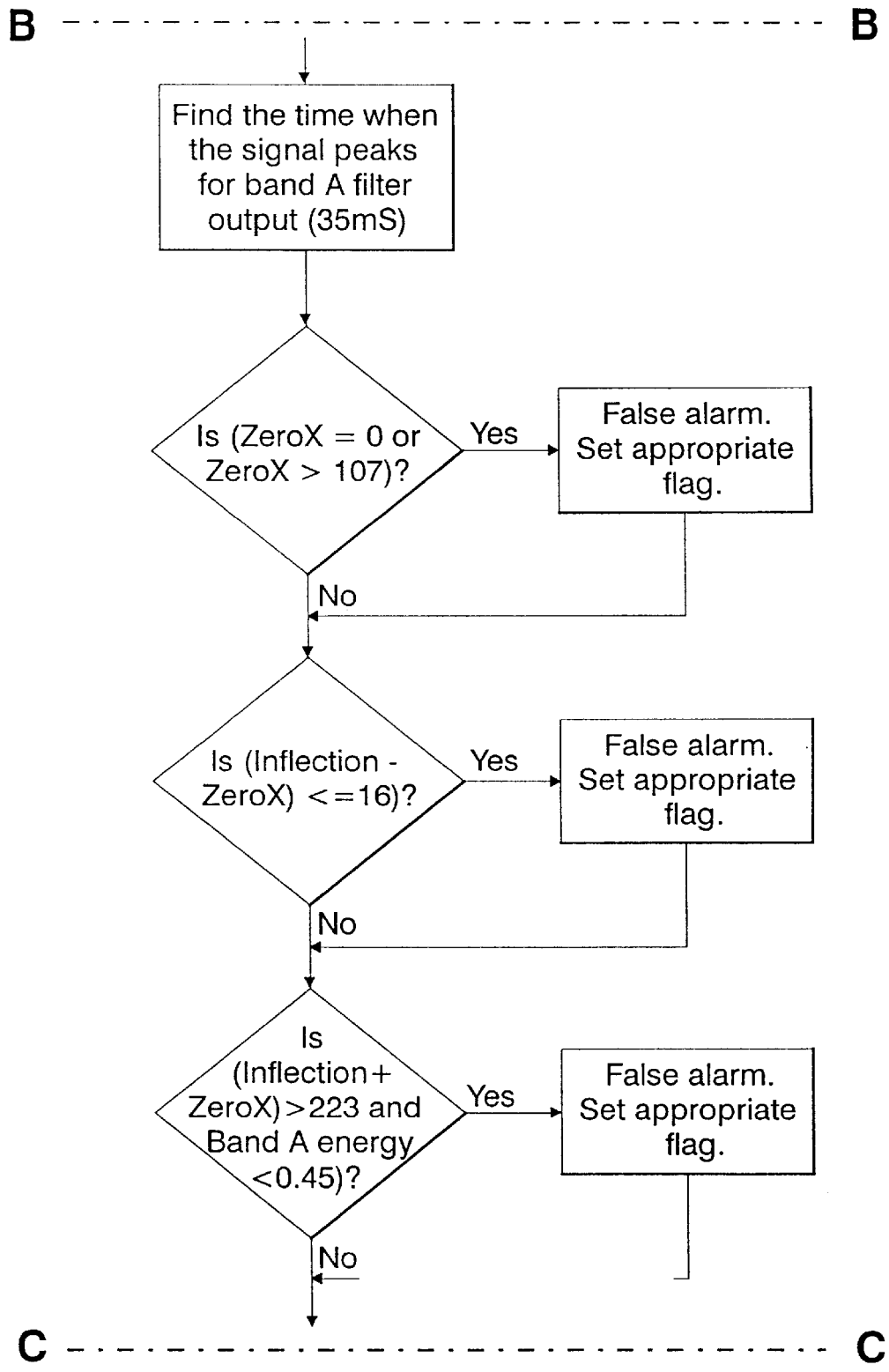
Figure 6D:
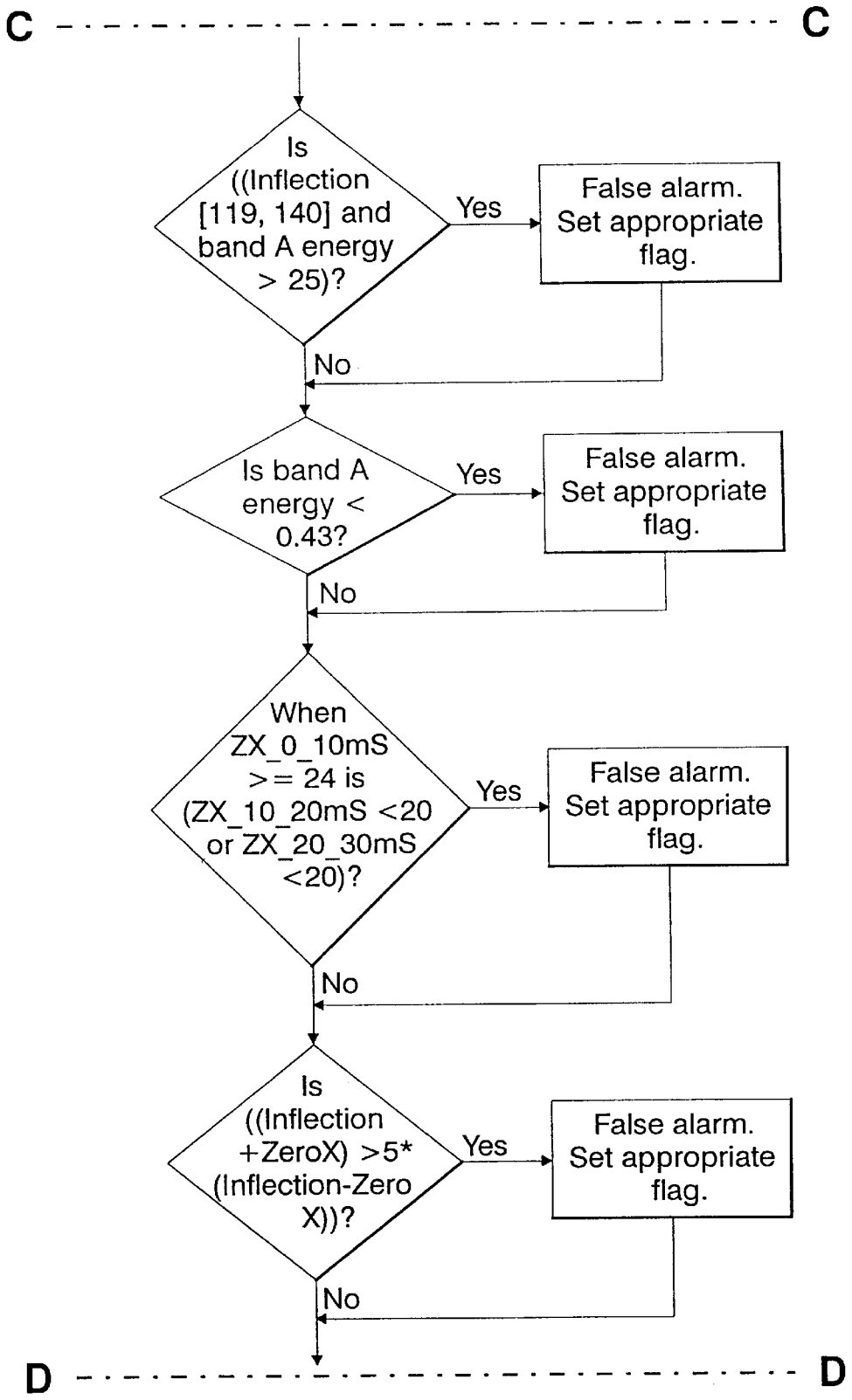
Figure 6E:
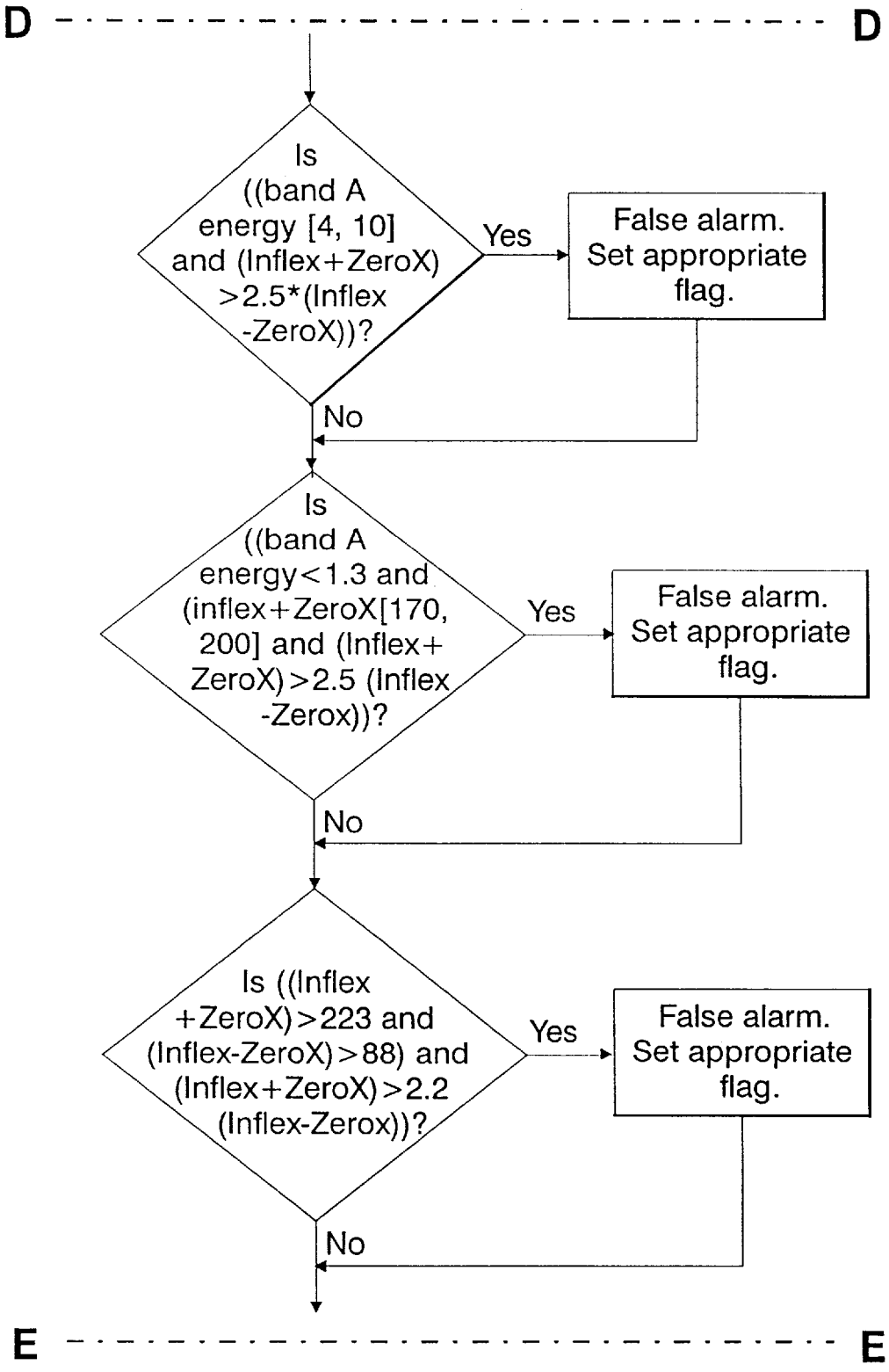
Figure 6F:
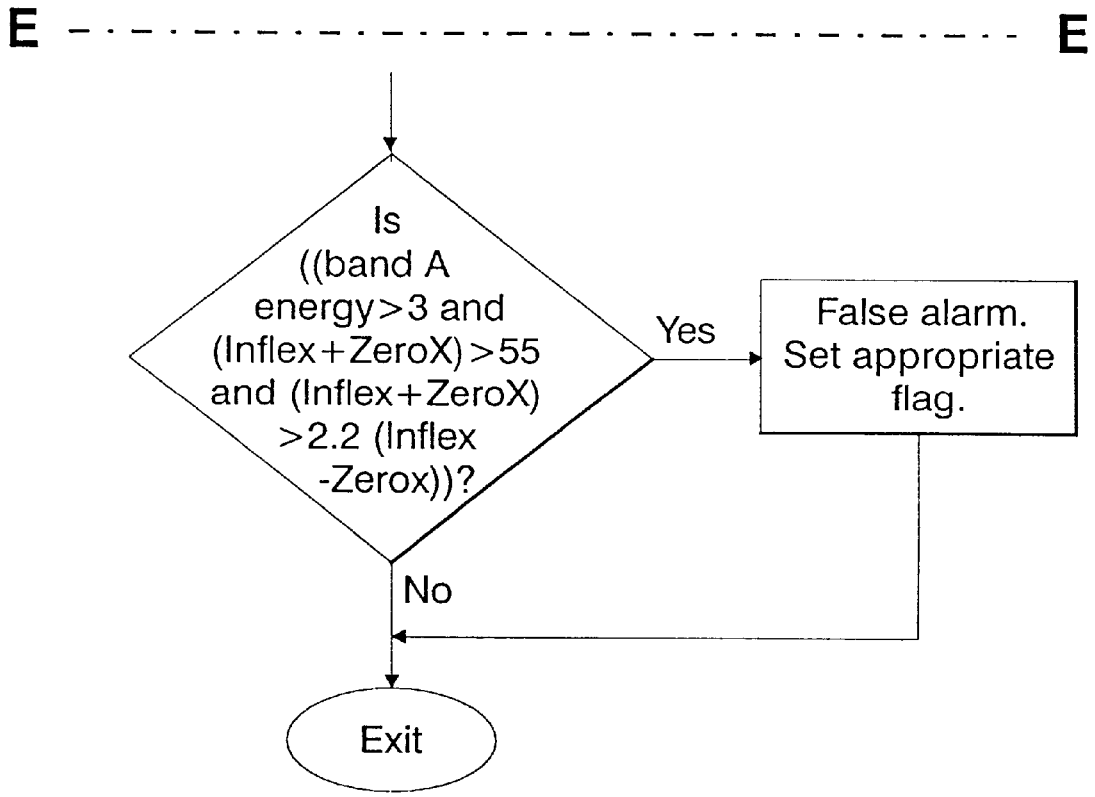

The feature extractor algorithm 18, flow chart shown in FIGS. 5A and FIG. 5B, uses five filters to filter the received sound. The filter parameters for the five filters A, B, C, D, and E, along with the test mode filter F are shown in FIG. 5C.

The feature extraction algorithm 18 collects data in real time. Each time there is an interrupt from timer 50, the program control 46 initiates an A/D conversion whose output X_N is used by the feature extraction algorithm 18. The feature extraction algorithm 18 subtracts the offset error from X_N and scales the data to represent a number between +/−2.5v. The algorithm performs the bandpass filter A. Digital filters are well known by one skilled in the art and are not described in detail here. The output from filter A is decimated by 5 without producing aliasing and saved in RAM 44. That is, since the signal is oversampled and filtered, only every fifth data sample from filter A is stored to conserve memory space. Next, the feature extraction algorithm 18 bandpasses the data with filter B and increments a count every time the sign changes from the previous sample. This is done for filters C, D, and E. The feature extraction algorithm 18 then checks if the sample has been taken in the first 2.5 milliseconds of data collection after passing the sound detection threshold. If the sample is prior to 2.5 milliseconds, the feature extraction algorithm 18 sums up the energy of the signal. Next, the period of the signal is computed by summing up the sample periods between zero crossings of the data from filter E. The feature extraction algorithm 18 continues storing zero crossings until 5 milliseconds have passed. At this point the algorithm checks if the time is greater than 20 milliseconds. If the time is not greater than 20 milliseconds, the minimum and maximum zero crossings counts for filters B, C, D, and E are updated. This will happen four times. If the time is greater than 20 milliseconds, the algorithm checks if the time is greater than 35 milliseconds. If the time is not greater, data is still collected. If the time is greater than the interrupts from timer 50 are turned off and the program control 46 starts the rules analysis algorithm 20.

The rules analysis algorithm 20 flowchart is shown in FIGS. 6A, 6B, 6C, 6D, 6E and 6F. The rules analysis algorithm 20 compares the extracted features against thresholds and limits to determine if the sound was a false alarm. The thresholds and limits were calculated by empirical analysis. A sound library which consists of thousands of different glass breakage sounds and non-glass breakage sounds was collected. Then a statistical analysis using standard errors, means, and histograms was used to determine the limits of the selected features. The limits were selected based on a 95% confidence level that the extracted features of a glass breakage sound would be between the lower limit and the upper limit for that feature.

The first feature checked by the rules analysis algorithm 20 is the energy during the first 2.5 milliseconds. A false alarm flag is set if the energy is too low. Next the energy of the signal above and below the bias is checked for symmetry. If it is not symmetrical a false alarm flag is set. Next the high frequency activity is looked at by checking that the sum of the zero crossing periods is above threshold. Next the four maximum and minimum zero crossing counts for filters B, C, D, and E are checked to be within limits. Next the rules analysis algorithm 20 computes the number of zero crossings, the number of inflections or changes in slope, the total energy, the time when the first zero crossing happens and the time when the signal peaks for the data stored from filter A. Components of these features are then checked against limits and thresholds. This processing is shown in detail in FIGS. 6C, 6D, and 6E. In these figures, ZeroX refers to the zero crossing count from the filter A data, ZX_10_20 ms refers to the number of zero crossings of filter A data between 10 milliseconds and 20 milliseconds, inflection[119,140] means the total number of inflections of the filter A data should be between 119 and 140, and band A energy[4,10] means the energy of the filter A data should be between 4 and 10.

Figure 7A:
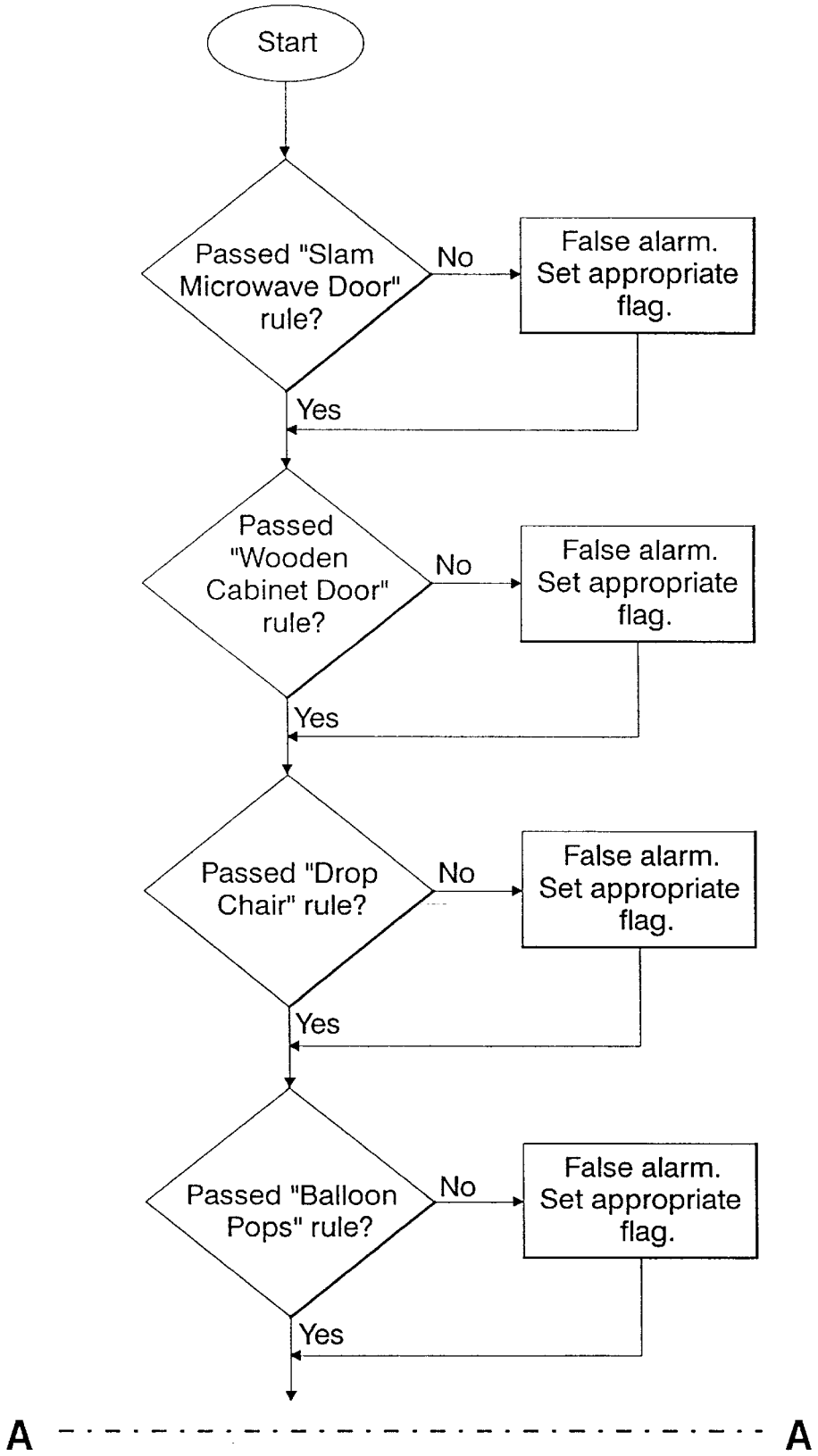
FIGS. 7A, 7B, and 7C combine together to form the flow chart of the operation of the difficult false alarm rules.
Figure 7B:
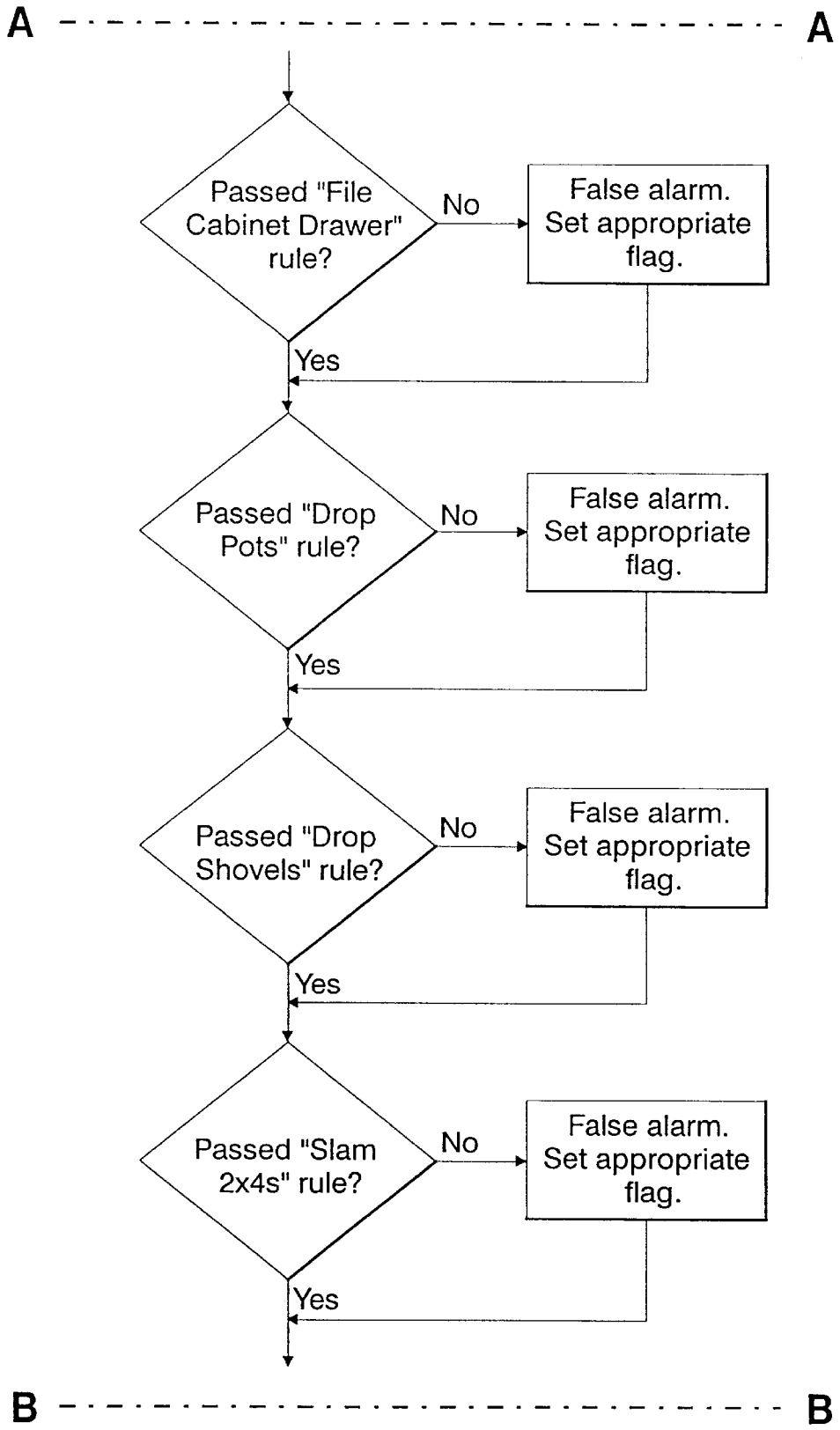
Figure 7C:
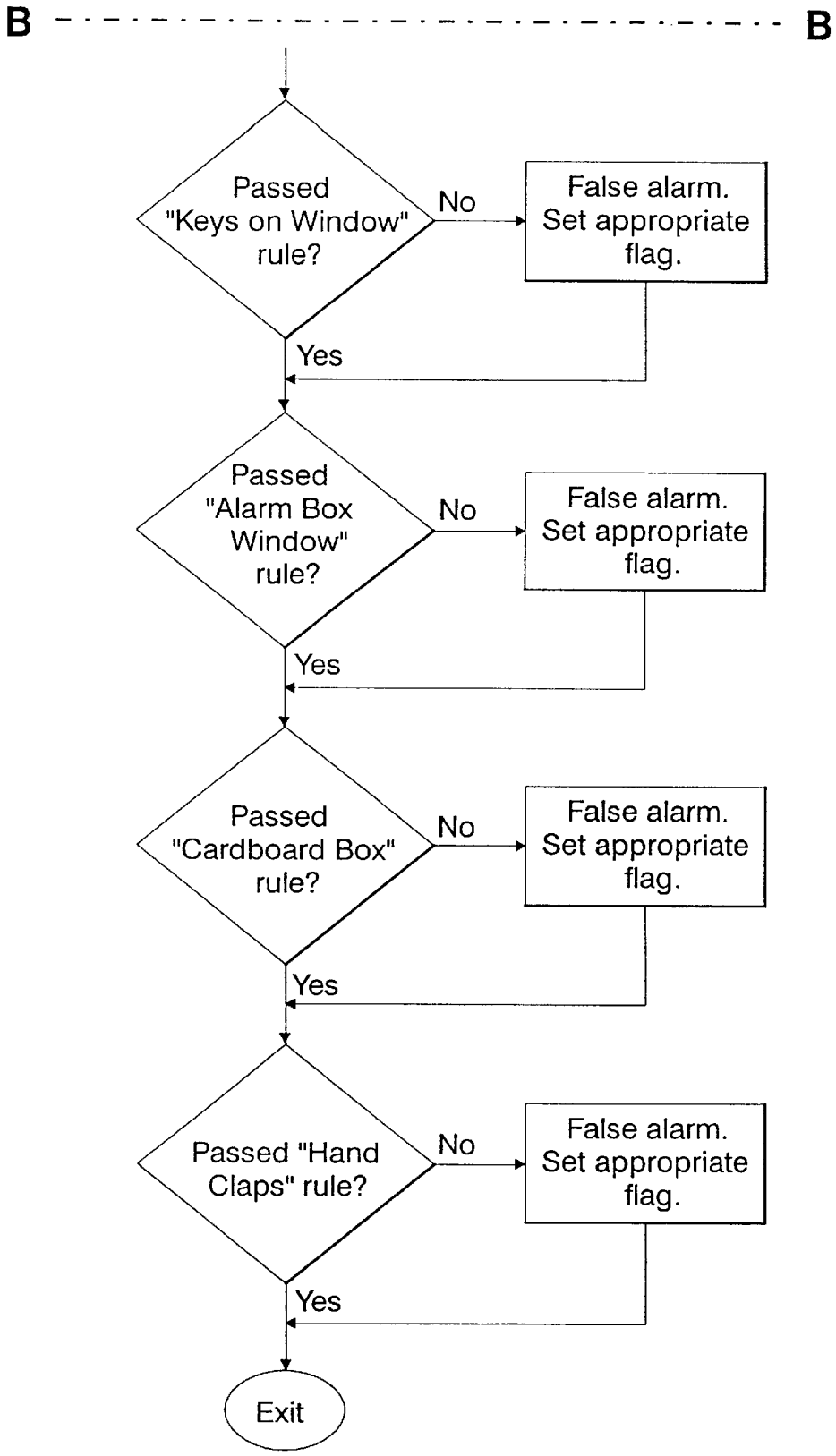

After the rules analysis algorithm 20, the program control 46 performs the difficult false alarm rule analysis algorithm 22. The flow chart containing all the false alarms checked by this algorithm is shown in FIGS. 7A, 7B, and 7C. The thresholds and limits for the false alarms were also calculated by empirical analysis. A library of sound recordings of the false alarm events was collected. Then again, statistical analysis using standard errors, means, and histograms was used to determine the limits of certain selected features. Each difficult false alarm rule checks a number of features similar to the rules analysis algorithm 20, described above. For example, to capture data useful for the Slam Microwave Door rule, the sounds from a number of microwave doors being slammed are sensed by an acoustic transducer (in an acoustically desirable environment), processed by a DSP, transmitted to a computer, and analyzed through statistical analysis to determine the limits of the rules needed to recognize the sound as being a false alarm.

After comparing the data to the difficult false alarms, the program control 46 checks if any false alarm flags were set. If none were set, an alarm condition is output. The program control 46 then transmits the extracted features (if connected to a computer) and goes to the beginning of the algorithms where the data interrupt is turned back on.

Another important aspect of the present invention is the ability of a user to select a different algorithm to process the signal sensed by the acoustic transducer. For example, during test mode, an installer is able to test the glass breakage detector by selecting the test mode in the glass breakage detector via a user input such as a switch and using a simulator that produces a 5 kHz tone. An algorithm is used by the glass breakage detector to optimally detect the simulated signal. The installer will have an accurate result as to the sensitivity and range of the glass breakage detector unlike the prior art detectors.

Figure 8:
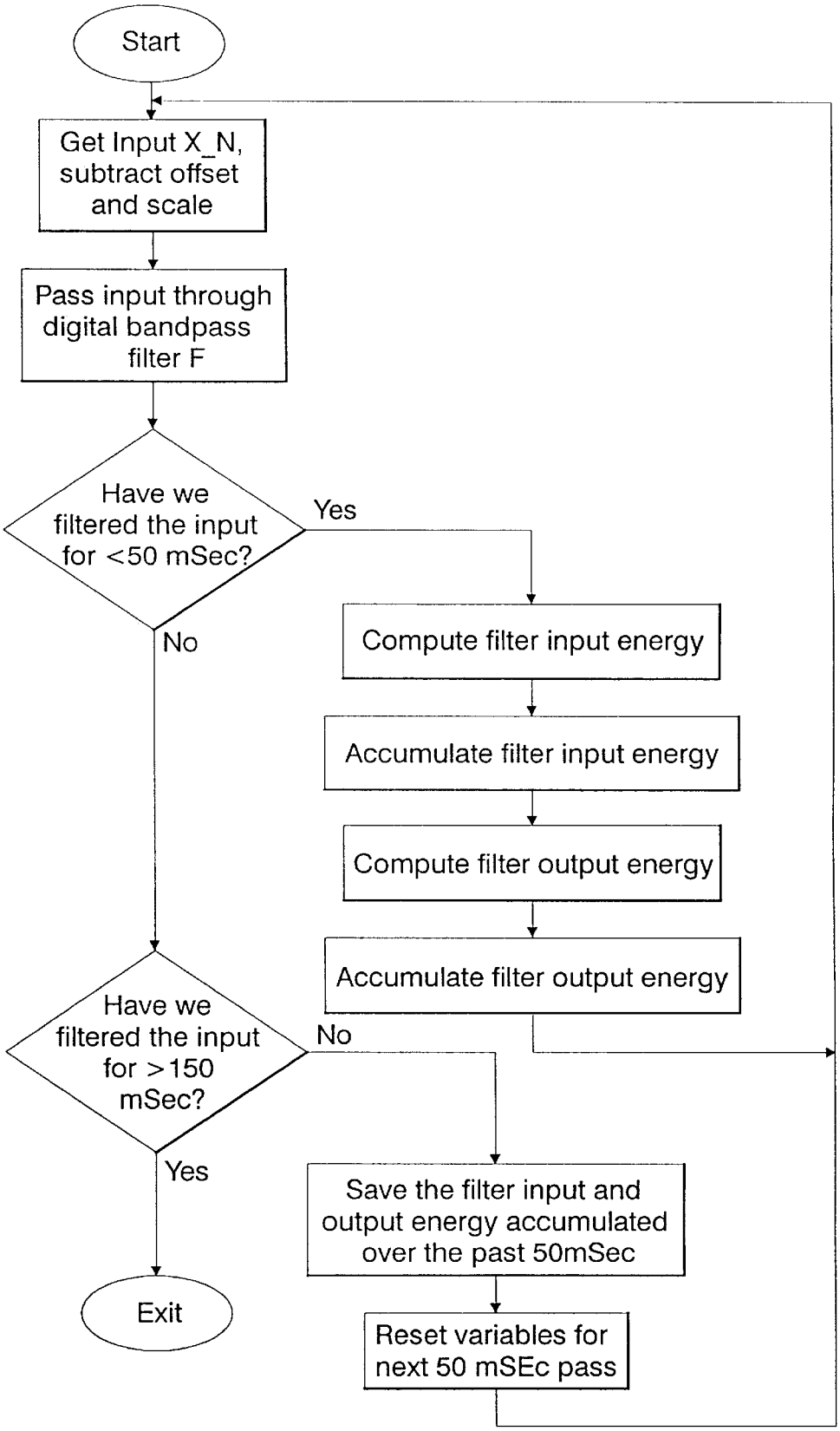
FIG. 8 illustrates the flow chart of the operation of the simulator event feature extractor algorithm.
Figure 9:
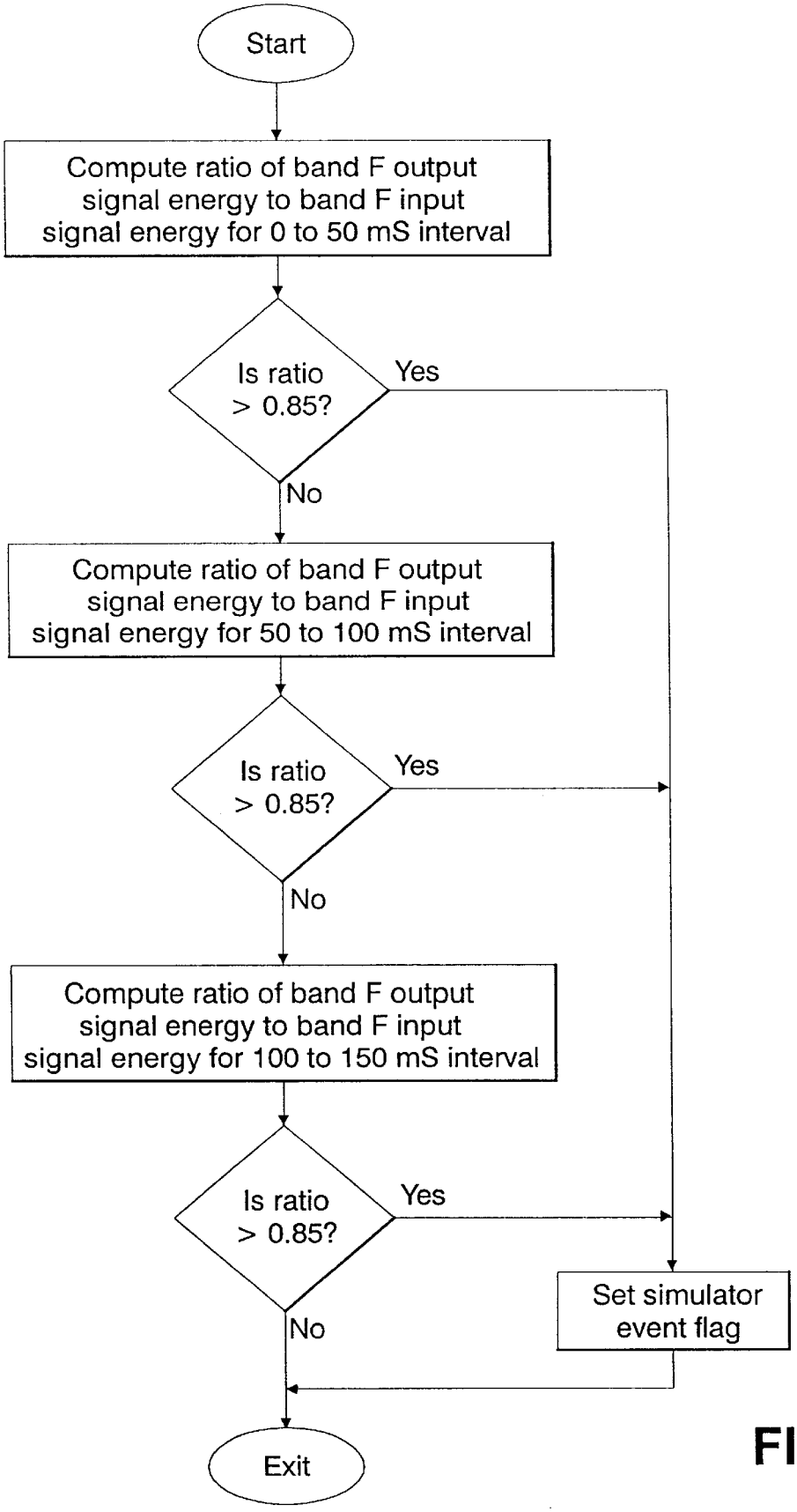
FIG. 9 illustrates the flow chart of the operation of the simulator event rules.

The algorithms used by the glass breakage detector during test mode are the simulator event feature extractor algorithm and simulator event rules algorithm. The flow chart of the simulator event feature extractor algorithm is shown in FIG. 8. Each time there is an interrupt from timer 50, the program control 46 initiates an A/D conversion whose output X_N is used by the simulator event feature extraction algorithm. The simulator event feature extraction algorithm 18 subtracts the offset error from X_N and scales the data to represent a number between +/−2.5v. The algorithm performs bandpass filter F. The algorithm next checks if data has been collected for more than a 50 millisecond interval. If data has not been collected for more than a 50 millisecond interval, the algorithm computes the filter input energy, accumulates the filter input energy, computes the filter output energy, accumulates the filter output energy, and continues to the beginning of the algorithm. If data has been collected for more than the 50 millisecond interval, the algorithm checks if data has been collected for more than 150 milliseconds. If it has not, the accumulated filter input energy and output energy from the past 50 millisecond interval are saved and the variables for processing the next 50 millisecond interval are reset. When the data has been collected for more than 150 milliseconds (three 50 millisecond intervals), the algorithm exits and the simulator event rules algorithm is performed. FIG. 9 shows the flow chart for the simulator event rules algorithm. This algorithm checks if the ratio of the energy of the filter output to the energy of the filter input is greater than 0.85. If this is true for any of the three intervals, a simulator event flag is set which causes an alarm signal to be output.

It will be apparent to those skilled in the art that modifications to the specific embodiment described herein may be made while still being within the spirit and scope of the present invention. For example, the wave shaping and anti-aliasing performed by the low gain amplifier 14 may be performed by the DSP 10 (if an oversampling high resolution A/D converter is used) in addition to the filtering it already performs. The A/D conversion may be performed by an external A/D converter rather than one resident in the DSP 10. Also the parameters of the low gain amplifier 14 and the DSP 10 filters (shown in table 5C) may be different. The flow of the algorithms, the extracted features, the thresholds and the limits may also be different.

Because of the versatility of the DSP 10 and the ability to change the software algorithms, other false alarm events and user selectable algorithms may be added. The user selectable algorithms may by selected by switches or by a remote device in communication with the glass breakage detector, i.e. an alarm system control unit, console, or a central station. In addition, the DSP 10 may be able to send control signals to external circuits based on the selection of algorithms. For instance, when the test mode is selected, the DSP 10 changes the gain of the amplifier 14 by transmitting a control signal which causes a transistor to switch a second resistor value into an amplifier circuit. In addition, more than one acoustic transducer may be processed by the DSP 10 using a common algorithm or using different algorithms specific for each acoustic transducer. Lastly, the transmitted features to the computer may be transmitted to the central station or may be stored by the DSP 10 for later analysis.

We claim:

1. A glass breakage detection device comprising:

a) an acoustic transducer for sensing acoustic waves and for providing an analog signal representative of the received acoustic waves, b) means for converting said analog signal to a digital signal, c) means for filtering said digital signal to produce a filtered digital signal, said means for filtering comprising:

i) means for multiplying said digital signal by a filter coefficient to produce a multiplied digital signal, ii) means for shifting said multiplied digital signal to produce a shifted digital signal, iii) means for accumulating said shifted digital signal to produce said filtered digital signal, and d) means for processing said filtered digital signal in accordance with a first algorithm stored in memory to determine if said received acoustic waves are a result of glass breakage.

2. The device of claim 1 further comprising means for generating an alarm signal if said processing means determines said received acoustic waves are a result of glass breakage.

3. The device of claim 1 further comprising means for amplification adapted to modify the amplitude of said analog signal to produce an amplified signal prior to said means for converting said analog signal to said digital signal, and wherein said means for converting converts said amplified signal to said digital signal.

4. The device of claim 3 wherein said means for amplification greater modifies the amplitude of higher frequency components of said analog signal.

5. The device of claim 1 wherein said acoustic transducer is adapted for a substantially flat gain response of the frequency range from approximately 20 Hz to approximately 20 kHz.

6. The device of claim 1 wherein said processing means and said first algorithm operate to detect the presence of an acoustic wave at said acoustic transducer.

7. The device of claim 1 wherein said processing means and said first algorithm operate to extract features from said filtered digital signal indicative of characteristics of said acoustic wave sensed by said acoustic transducer.

8. The device of claim 7 further comprising a memory, said memory comprising a first set of rules, and wherein said processing means further comprises means for analyzing said features with respect to the first set of rules stored in memory to determine if said received waves are a result of glass breakage.

9. The device of claim 8 wherein when said features meet said first set of rules an alarm condition is indicated.

10. The device of claim 8 wherein when said features do not meet said first set of rules an alarm condition is not indicated.

11. The device of claim 7 further comprising a memory, said memory comprising a first set of rules, and wherein said processing means further comprises means for analyzing said features with respect to the first set of rules stored in memory to determine if said received waves are not a result of glass breakage.

12. The device of claim 1 wherein said means for filtering said digital signal produces a plurality of filtered digital signals, wherein said plurality of filtered digital signals is produced by multiplying said digital signal by a plurality of filter coefficients.

13. The device of claim 1 further comprising means for initiating a test mode.

14. The device of claim 13 further comprising a second algorithm stored in memory, and wherein said processing means processes said filtered digital signal in accordance with said second algorithm to determine if said received acoustic waves are a result of a simulated acoustic wave from a signal generator when said test mode has been initiated.

15. A method for detecting glass breakage comprising the steps of:

a) sensing an acoustic wave with a transducer to produce an analog signal, b) converting said analog signal to a digital signal, c) filtering said digital signal to produce a filtered digital signal, wherein said filtering comprises the steps of:

i) multiplying said digital signal by a filter coefficient to produce a multiplied digital signal, ii) shifting said multiplied digital signal to produce a shifted digital signal, iii) accumulating said shifted digital signal to produce said filtered digital signal, and d) processing said filtered digital signal in accordance with a first algorithm stored in memory to determine if said acoustic wave is a result of glass breakage.

16. The method of claim 15 further comprising the step of generating an alarm signal when it is determined that said acoustic wave is the result of glass breakage.

17. The method of claim 15 further comprising the step of amplifying said analog signal to produce an amplified signal prior to converting said analog signal to said digital signal.

18. The method of claim 17 wherein said step of amplifying is greater for higher frequency components of said analog signal.

19. The method of claim 15 wherein said acoustic transducer is adapted for a substantially flat gain response of the frequency range from approximately 20 Hz to approximately 20 kHz.

20. The method of claim 15 wherein the step of processing said filtered digital signal comprises detecting the presence of an acoustic wave at said acoustic transducer.

21. The method of claim 15 wherein the step of processing said filtered digital signal comprises extracting features from said filtered digital signal indicative of characteristics of said acoustic wave sensed by said acoustic transducer.

22. The method of claim 21 wherein the step of processing said filtered digital signal further comprises analyzing said features with respect to a first set of rules to determine if said received acoustic waves are a result of glass breakage.

23. The method of claim 22 wherein when said features meet said first set of rules an alarm condition is indicated.

24. The method of claim 22 wherein when said features meet said first set of rules an alarm condition is not indicated.

25. The method of claim 21 wherein the step of processing said filtered digital signal further comprises analyzing said features with respect to a first set of rules to determine if said received acoustic waves are not a result of glass breakage.

26. The method of claim 15 wherein the step of filtering said digital signal is performed a plurality of times using different filter coefficients each time, and producing a plurality of filtered digital signals.

27. The method of claim 15 further comprising the step of initiating a test mode.

28. The method of claim 27 further comprising the step of processing said filtered digital signal in accordance with a second algorithm to determine if said received acoustic waves are a result of a simulated acoustic wave from a signal generator when said test mode has been initiated.

29. A processing device comprising:

a) means for receiving a signal correlated to an acoustic wave detected by a transducer, b) means for filtering said signal to produce a filtered signal, said means for filtering comprising:

i) means for multiplying said signal by a filter coefficient to produce a multiplied signal, ii) means for shifting said multiplied signal to produce a shifted signal, iii) means for accumulating said shifted signal to produce said filtered signal, and c) means for processing said filtered signal in accordance with an algorithm stored in memory to determine if said signal is the result of glass breakage.

30. The device of claim 29 wherein said device is locally coupled to an acoustic transducer located in close proximity thereto in a common housing.

31. A glass breakage detection device comprising:

a) an acoustic transducer for sensing acoustic waves and for providing an analog signal representative of the received acoustic waves, b) means for converting said analog signal to a digital signal, c) means for processing said digital signal in accordance with a first algorithm stored in memory to determine if said received acoustic waves are a result of glass breakage, and d) input means for allowing a user to modify said first algorithm.

32. The device of claim 31 wherein said first algorithm comprises a set of predefined algorithms and said input means allows said user to select an algorithm from said set of predefined algorithms.

33. The device of claim 31 wherein said processing means and said first algorithm operate to filter said digital signal to produce a filtered digital signal, and wherein said input means allows a user to select the filter characteristics.

34. The device of claim 33 wherein said processing means and said first algorithm operate to extracts features from said filtered digital signal, and wherein said input means allows a user to select the features to extract.

35. The device of claim 34 further comprising a memory, said memory comprising a set of rules, and wherein said processing means further comprises means for analyzing said features with respect to the set of rules stored in memory to determine if said received waves are a result of glass breakage, and wherein said input means allows a user to select the rules from said set of rules to determine if said received acoustic waves are a result of glass breakage.

* * * * *